United States Patent [19]

Mizutani

[11] Patent Number: 4,615,608

[45] Date of Patent: Oct. 7, 1986

[54] DEVELOPING APPARATUS

[75] Inventor: Morikazu Mizutani, Tokyo, Japan

[73] Assignee: Canon Kabushiki Kaisha, Tokyo, Japan

[21] Appl. No.: 663,484

[22] Filed: Oct. 22, 1984

[30] Foreign Application Priority Data

| | | | |
|---|---|---|---|
| Oct. 31, 1983 | [JP] | Japan | 58-204332 |
| Feb. 8, 1984 | [JP] | Japan | 59-21086 |
| Oct. 12, 1984 | [JP] | Japan | 59-213365 |
| Oct. 12, 1984 | [JP] | Japan | 59-213366 |

[51] Int. Cl.[4] ..... G03G 15/06

[52] U.S. Cl. ..... 355/3 DD; 222/DIG. 1; 222/544; 118/658

[58] Field of Search ..... 355/3 DD, 3 R, 14 D; 222/DIG. 1, 544; 118/656, 657, 658

[56] References Cited

U.S. PATENT DOCUMENTS

| | | | |
|---|---|---|---|
| 2,904,000 | 9/1959 | Fisher et al. | 355/3 DD |
| 3,923,391 | 12/1975 | Washio et al. | 355/8 X |
| 3,999,654 | 12/1976 | Pollack | 222/DIG. 1 |
| 4,062,385 | 12/1977 | Katusha et al. | 222/544 X |
| 4,226,525 | 10/1980 | Sakamoto et al. | 355/3 DD |
| 4,406,535 | 9/1983 | Sakamoto et al. | 355/3 DD |
| 4,491,161 | 1/1985 | Tamura et al. | 355/3 DD |

*Primary Examiner*—R. L. Moses

*Attorney, Agent, or Firm*—Fitzpatrick, Cella, Harper & Scinto

[57] ABSTRACT

A developing apparatus is provided with a developer storing container which includes a first developer storing chamber and a second developer storing chamber which are independent from each other. Each of the first and second chambers has an opening. The openings are sealed by a first and second sealing members, respectively in the manner that the second sealing member can be removed only after the first sealing member is removed.

19 Claims, 19 Drawing Figures

DEVELOPING APPARATUS

BACKGROUND OF THE INVENTION

The present invention relates to a developing apparatus for visualizing with dry developer (toner) a latent image, such as an electrostatic latent image and a magnetic latent image, formed on a latent image bearing surface, such as a photosensitive member, a dielectric member or a magnetic member, using a known principle or process, such as electrophotography, electrostatic recording or magnetic recording.

Conventionally, various types of apparatus have been proposed and put into practice as to a dry type one-component developer apparatus. However, in any of those types, it has been very difficult to form a thin layer of one-component dry developer, so that a relatively thick layer of the developer is used. On the other hand, the recent demand for the improved sharpness, resolution or other qualities has necessitated the achievement of the system for forming a thin layer of one-component dry developer.

A method of forming a thin layer of one-component dry developer has been proposed in U.S. Pat. Nos. 4,386,577 and 4,387,664, and this has been put into practice. However, this is the formation of a thin layer of a magnetic developer, not of a non-magnetic developer. The particles of a magnetic developer must each contain a magnetic material to gain a magnetic nature. This is disadvantageous since it results in poor image fixing when the developed image is fixed on a transfer material, also in poor reproducibility of color (because of the magnetic material, which is usually black, contained in the developer particle).

Therefore, there has been proposed a method wherein the developer is applied by cylindrical soft brush made of, for example, beaver fur, or a method wherein the developer is applied by a doctor blade to a developer roller having a textile surface, such as a velvet, as to a formation of non-magnetic developer thin layer.

In the case where the textile brush is used with a resilient material blade, it would be possible to regulate the amount of the developer applied, but the applied toner layer is not uniform in thickness. Moreover, the blade only rubs the brush so that the developer particles are not electrically charged, resulting in foggy images.

The magnetic developer can be relatively easily controlled by a magnetic force, because of its magnetic nature influenced by the magnetic force, but the non-magnetic developer can not be controlled by a magnetic force, because it is not influenced by the magnetic force. For this reason, the non-magnetic developer is easily scattered inside the apparatus. This disadvantage can occur, not only during the copying operation, but also during the handling or transportation of the apparatus which may result in a vibration or shock.

SUMMARY OF THE INVENTION

It has been proposed in, for example, U.S. Ser. Nos. 466,574 and 601,715 which have been assigned to the assignee of this application, that non-magnetic developer particles and magnetic particles are used. In this method, a magnetic particle confining member is provided to oppose a developer carrying member, and a magnetic brush of magnetic particles are formed by a magnetic force provided by magnetic field generating means, at a position upstream of the magnetic particle confining member with respect to the movement of the developer carrying member, the magnetic brush is confined or limited by the magnetic particle confining member, whereby a thin layer of non-magnetic developer particles is formed on the developer carrying member. By this method or apparatus, a thin layer only of the non-magnetic developer particles is formed on the developer carrying member. This makes it possible to perform color development.

However, if the magnetic particles and the non-magnetic developer particles are supplied to the developer carrying member in an erroneous order at the start of the use of this developing apparatus, the intended thin layer only of the non-magnetic developer particles can not be formed, and/or the developer particles are leaked at the bottom of the apparatus, resulting in contamination around the developing apparatus.

Accordingly, it is a principal object of the present invention to provide a developing apparatus, wherein, upon the initiation of the use of the apparatus, a first component of the developer is first supplied to a developer supply container, and then the second component thereof is supplied thereto, thus placing the developing apparatus into an operable state, and wherein the possibility of supplying the first component and the second component in an erroneous order is strictly prevented.

It is another object of the present invention to provide a developing apparatus wherein a better confinement of the magnetic particles and a stabilized and uniform circulation of the developer are assured with a simple structure, wherein a thin layer of developer particles is stably formed on the developer carrying member surface for a long term, and wherein the possibility of the developer scattering is effectively prevented, so that a good image can be provided.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
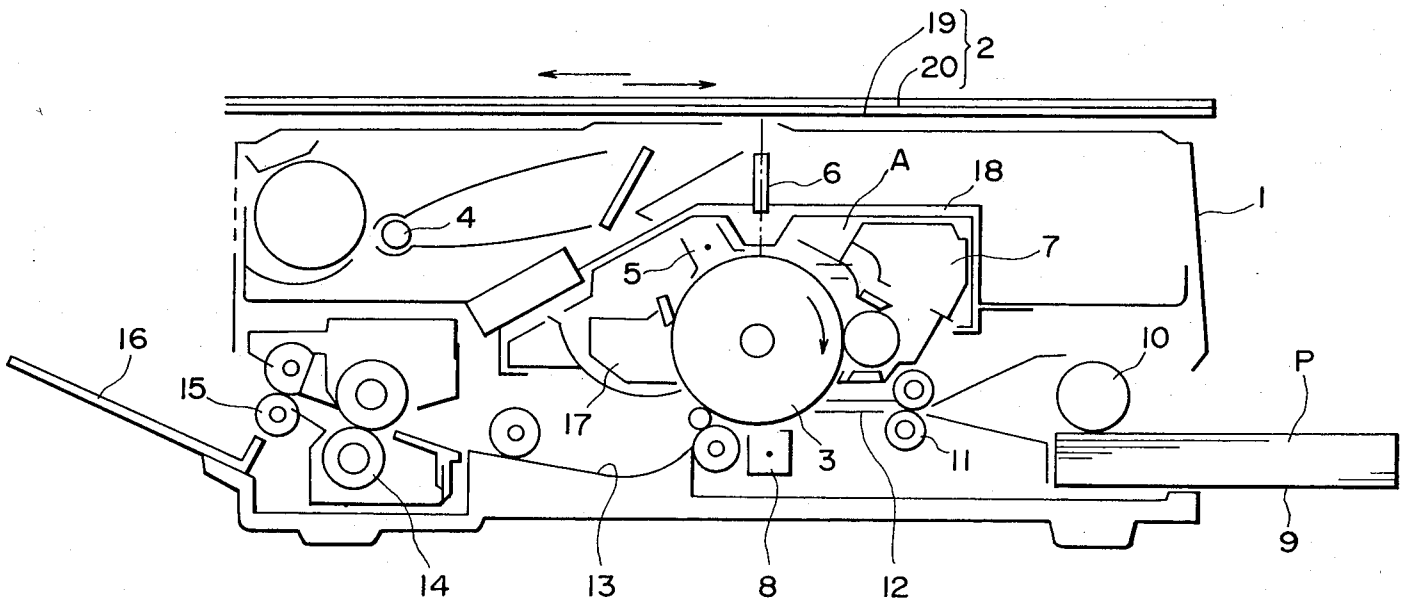
FIG. 1 is a cross-sectional front view of an electrophotographic copying apparatus having therein a developing apparatus according to the present invention.

Referring now to FIG. 1, there is shown an electrophotographic copying apparatus to which the developing apparatus according to the present invention is applicable, wherein the electrophotographic copying apparatus is shown as a small-size, that is, personal type electrophotographic copying apparatus which is loadable with a cartridge containing the developing apparatus. In this copying apparatus, an original to be copied is placed facedown at a predetermined position on a platen glass 19 of a reciprocable original carriage 2 reciprocably mounted on the upper part of an outer casing of the copying apparatus. Then, an original holding plate 20 covers the original. When a copy start button (not shown) is depressed, various operations are interrelatedly performed, such as rotation of a photosensitive drum 3 in the direction shown by an arrow, actuation of an original illuminating lamp, movement of the original carriage 2 and the drive and energization of the other process means, thereby performing the copying operation. More particularly, the photosensitive drum 3 which started rotating, is electrically charged to a predetermined polarity by a corona discharger 5 to a predetermined polarity, and then exposed to a light image of the original placed on the reciprocating original carriage 2 through a slit and through an array 6 of optical elements each having a short focal length so that an electrostatic latent image of the original is formed on the photosensitive member. The latent image thus formed is then developed as a toner image by a developing device 7 and advanced to an image transfer station wherein a transfer corona discharger 8 is provided.

On the other hand, a transfer material or sheet P is fed one by one by a sheet supply roller 10 from a paper cassette. The transfer sheet P is advanced by a registering rollers 11 synchronously with the rotation of the photosensitive drum 3 and is guided by a guiding member 12 toward between the photosensitive drum 3 and the transfer corona discharger 8 at the transfer station, where the developed image on the photosensitive drum 3 is transferred to the transfer sheet P by the transfer corona discharger 8. The transfer sheet is then separated from the surface of the photosensitive drum 3 and is advanced to an image fixing device 14 along a sheet passage 13. After the image is fixed, the transfer sheet is discharged out to a copy tray 16 by a couple of discharging rollers. The surface of the photosensitive drum 3, after the image has been transferred therefrom, is cleaned by a cleaning device 17 so as to become prepared for the next image formation.

The photosensitive drum 3, the corona discharger 5, the developing device 7 and the cleaning device 17 are mounted has a unit on a common frame 18 in a predetermined positional relationship in a cartridge A. The cartridge A can be loaded into the main assembly of the copying apparatus through the front door thereof, and it can be taken out of the main assembly therethrough. When the cartridge A is inserted into the main assembly to a sufficient extent, the mechanisms and means in the cartridge A are mechanically and/or electrically connected with the main assembly side so that the cartridge A can be supplied with a mechanical drive and/or an electric power from the driving mechanisms or power supply circuits of the main assembly.

A predetermined integrated number of copies which has been determined in terms of the service life of the built-in photosensitive drum 3 or the amount of the developer contained in the developing device (for example, 2000 copies), the cartridge is replaced with a new one. It is possible to prepare a plurality of cartridges which contains developers of different colors so that the cartridges are interchangeable to obtain copies of different color.

In a commonly assigned copending application, it has been proposed a developing device wherein the developer particles are firstly supplied into a developer supply container so that they are attracted on the surface of the developer carrying member and are formed as a first layer, that is, a magnetic particle layer thereon in the developer supply container, and then the non-magnetic developer particles are supplied so that they are accumulated on the developer particle layer as a second layer outside the developer particle layer. By this structure, a thin layer of non-magnetic developer particles is formed on the developer carrying member and is conveyed to a developing station to develop the latent image on a latent image bearing member (U.S. Ser. No. 638,768).

Figure 2:
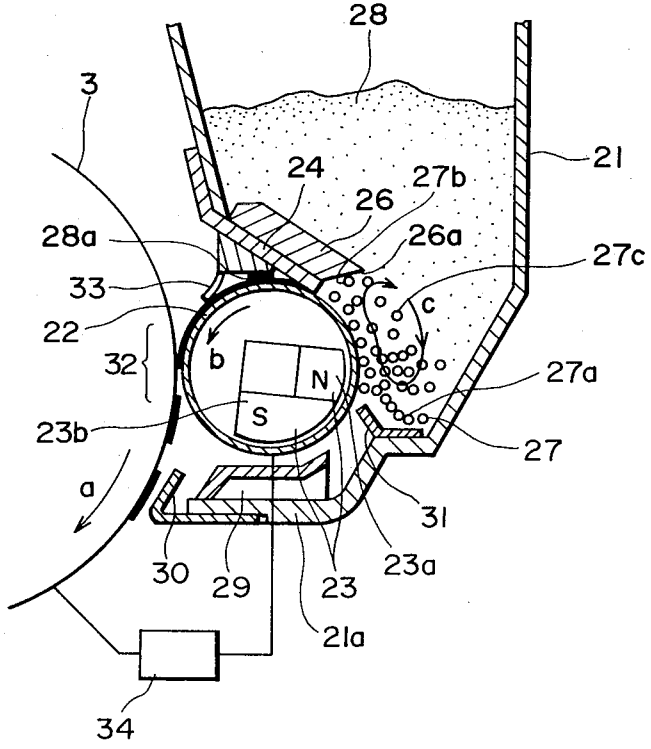
FIG. 2 is a cross-sectional view of an example of a developing apparatus to which the present invention is applicable.

FIG. 2 is a cross-sectional view of a developing device of the above-described type. The device includes a developer container 21 and a developing sleeve 22 as the developer carrying member. The developing sleeve 22 is made of a non-magnetic material such as aluminum, and provided in a rectangular opening formed at a lower part of the left-hand side wall of the container 21 as seen in FIG. 2 and extending along the length of the container 21, in the manner that about one-half, that is, the right-hand side half in the Figure is in the container 21, while the remaining half, that is, left-hand half is exposed outside, and in the manner that it is journalled so as to be rotatable in the counterclockwise direction b. Although the developer carrying member 22 is shown as a cylindrical member (sleeve), this is not limiting, but a rotatable endless belt may be used in place thereof. The part of the surface of the developing sleeve which is exposed outside is opposed to the surface of a latent image bearing member 3, such as a photosensitive member, with a small clearance. The image bearing member 3 is rotatable in the direction shown by an arrow a.

Within the developing sleeve 22, there is provided a stationary permanent magnet which functions as stationary magnetic field generating means. The magnet 23 is located and positioned as shown in the Figure. Since the magnet is fixed, it keeps its location and position as shown in the Figure, even when the developing sleeve 22 is rotated. The magnet 23 includes N pole 23*a* and S pole 23*b*. The permanent magnet 23 may be replaced by an electromagnet.

A magnetic blade 24 is provided at the top end of the opening of the developer supply container, in which the developing sleeve 22 is provided. The base portion of the magnetic blade 24 is fixedly secured to the wall of the container 21, while the free end thereof is more inside of the container 21 than the upper end of the opening. The magnetic blade 24 functions as magnetic particle confining member. The magnetic blade 24 is made of a steel plate having a cross-section of "L" obtained by bending.

Figure 3:
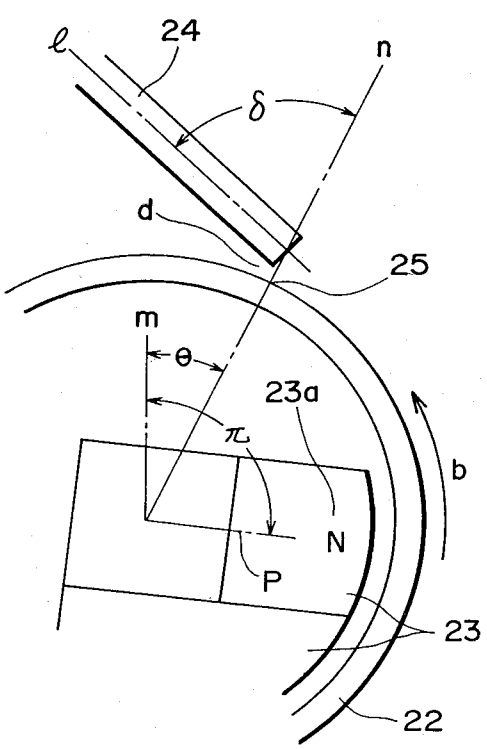
FIG. 3 illustrates the positioning and the angle of a developing sleeve and the magnetic blade of the apparatus shown in FIG. 2.

FIG. 3 illustrates the positional and angular relation between the magnetic blade 24 and the developing sleeve 22 in this Figure, reference numeral 25 indicates a point on the sleeve 22 which is downstream of the magnetic pole 24 with respect to the movement of the sleeve 22, and which is upstream of the upper end of the opening of the container 21 with respect to the movement of the sleeve 22; l is a center line of the magnetic blade 24; n is the line normal to the sleeve surface 22 passing through the point 25. The free end of the magnetic blade 24 is opposed to the surface of the sleeve 22 at the point 25 with a clearance d from the surfce of the sleeve 22. The magnetic blade 24 is positioned such that the center line thereof l is inclined by an angle $\delta$ with respect to the normal line n of the sleeve 22 at the point 25 thereof toward the downstream with respect to the movement of the sleeve 22, as shown in the Figure. The normal line n forms an angle $\theta$ with the vertical line m passing through the center O of the sleeve 22. Designated by a reference character q is a line connecting the center of the sleeve 22 and the center of the magnetic pole 24, which line forms an angle $\pi$ with the vertical line m, that is, the angular position of the magnetic pole 24 is expressed by this angle.

The clearance d between the surface of the developing sleeve 22 and the end of the magnetic blade 24 at the point 25 is 100–1000 microns, preferably 200–500 microns, and it is 250 microns in this embodiment. The clearance d which is smaller than 100 microns, results in the magnetic particles clogging in the clearance and leaking out of the container through the clearance. If, on the other hand, it is larger than 1000 microns, a large amount of the non-magnetic developer leaks out by vibration, so that the thin layer thereof can not be formed.

As shown in FIG. 2, on the upper surface of the magnetic blade 24, a member for limiting the magnetic particle circulating region. The member 26 has a bottom surface contacted to the upper surface of the magnetic blade 24 and a front undercut surface 26*a*. Designated by reference numerals 27 and 28 are magnetic particles and non-magnetic developer particles, respectively, which have been sequentially supplied into the container 21.

A bottom plate of the container 21 is extended below the developing sleeve 22 to prevent the developer particles from leaking out. In order to further ensure the prevention of the developer particle leakage, the extended plate 21*a* is provided at its upper surface with a portion 29 for receiving and capturing the leaked developer particles and is provided with a member 30 for preventing the leaked toner particles from scattering around, along the length of the edge of the extended bottom plate 21*a*. To this member 30, a voltage is applied, which will be described hereinafter.

The particle size of the magnetic particles 27 is 30–200 microns, preferably, 70–150 microns. Each of the magnetic particles may consist of a magnetic material or materials, or a mixture or combination of a magnetic material or materials and a non-magnetic material or materials. The magnetic particles 27 are first supplied into the developer container 21. By this, the magnetic particles 27 are attracted by the magnetic field provided by the magnet 23 to all the sleeve 22 surface that are faced to the magnetic particles 27 within the container 21, that is, the surface of the sleeve 22 extending from the neighborhood of the free end of the magnetic blade 24 to the neighborhood of a magnetic member 31 which is disposed to the sleeve 22 to prevent the magnetic particles and/or the developer particles from leaking out of the container 21. Those magnetic particles cover the entire sleeve surface within the container 21 to form a magnetic particle layer. After the magnetic particles 27 are introduced into the container 21 as described above, the non-magnetic developer particles 28 are supplied thereinto. By doing so, a large amount of the non-magnetic developer particles are accommodated on and outside of the first layer, thus forming a second layer.

It is preferable that the magnetic powder 27 contains 2–70% (by weight with respect to the magnetic powder) non-magnetic developer 28, but the magnetic powder 27 may consist only of the magnetic particles. Once the magnetic particles 27 are attracted onto the surface of the sleeve 22 as the magnetic particle layer, they are not significantly made to flow or driven to one side by the subsequent vibration or by inclining the apparatus, and therefore, the magnetic particles keep covered the entire surface of the sleeve 22 in the container.

When the container 21 accommodates the magnetic particles 27 and the non-magnetic developer particles 28 which have been sequentially supplied thereto, a magnetic brush 27*a* is formed, by the strong magnetic field provided by the magnetic pole 23*a*, at the magnetic particle layer in the neighborhood of the sleeve surface opposed to the magnetic pole 23*a* of the magnet 23.

A portion of the magnetic particle layer which is adjacent to the free end of the magnetic blade 24 as the magnetic particle confining member, is confined at the point 25 on the sleeve 22 surface to form a stationary layer 27*b* which is substantially unmovable, although slightly movable, because of the balance between the confining force due to the gravity, the magnetic force and a confining force which is the effect of the existence of the magnetic blade 24, and the conveying force provided by the rotation of the sleeve 22 when the sleeve 22 is rotationally driven in the direction shown by the arrow b.

By properly selecting the position of the magnetic pole 23*a* and the flowability and the magnetic property of the magnetic particles 27, the magnetic brush 27*a*, upon the rotation of the sleeve 22 in the direction shown by the arrow b, circulates in the neighborhood of the magnetic pole 23*a* in the direction shown by an arrow c, thus forming a circulating layer 27*c*. In the circulating layer 27*c*, the part of the magnetic particles which are adjacent to the sleeve 22 are advanced up, by the rotation of the sleeve 22, on the stationary layer 27*b* existing from the neighborhood of the magnetic pole 23*a* toward the downstream with respect to the rotation of the sleeve. In other words, they receive the upward force.

The advancing magnetic particles are limited by the circulation limiting member 26 mounted on the upper surface of the magnetic blade 24 which is effective to define the upper limit of the circulation, and therefore, the magnetic particles do not advance on the magnetic blade 24, so that they fall by the gravity and return to the neighborhood of the magnetic pole 23*a*. The magnetic particles 27 which receive less upward force, because of, for example, being away from the surface of the sleeve 22, may fall before they reach the circulation limiting member. Thus, in the circulating layer 27*c*, the magnetic brush 27*a* of the magnetic particles circulate, as shown by the arrow c, due to the gravity, the magnetic force by the magnetic pole, the friction force and the flowability (viscosity) of the magnetic particles. During the circulation, the magnetic brush takes therein the non-magnetic developer particles 28 from the non-magnetic developer layer on the magnetic particle layer, and then the magnetic particles return to the bottom of the container 21. This circulation is repeated together with the rotation of the sleeve 22. The magnetic blade 24 does not directly relate to the circulation.

The effect of the limiting member 26 can be expected if the limiting member 26 is such that an angle formed between the normal line n as defined with respect to FIG. 3 and the inclined surface of the limiting member 26 is larger than −45 degrees and smaller than 70 degrees ("positive" in the clockwise direction), when the angle $\theta$ defined with FIG. 3 is 30 degrees. If the angle defined above is smaller than −45 degrees, the magnetic particles run on the limiting member 26, so that the intended effect thereof is not provided. If the angle is equal to 70 degrees, the space defined by the surface of the sleeve 22 and the limiting member 26 is so narrow that the magnetic particles are easily pushed out. The angle is preferably larger than −30 degrees and smaller than 55 degrees.

Non-magnetic developer particles taken by and mixed into the magnetic particle layer on the surface of the sleeve 22 are triboelectrically charged by the movement of the magnetic particles resulting in the friction of the non-magnetic developer particles with the magnetic particles and with the surface of the developing sleeve 22. Preferably, however, the triboelectric charge with the magnetic particles 27 is reduced by treating the surface of the magnetic particle 27 with an insulating material, such as oxide coating and a resin having the same electrostatic level as the non-magnetic developer, so that the necessary charging is effected by the contact or friction with the developing sleeve 22 surface. Then, the deterioration of the magnetic particles is prevented, and simultaneously, the non-magnetic developer is stably applied on the carrying member 12. The developer thus charged is non-magnetic, and therefore it is not influenced or confined by the magnetic field of the magnetic pole 23*a*. During the movement or rotation of the surface of the sleeve 22 from the point of the magnetic member 31 at the bottom of the container 21 to the free end of the magnetic blade 24, the non-magnetic developer particles are applied on the surface of the sleeve 22 as a thin coating layer of a uniform thickness by an image force.

On the other hand, the magnetic particles in the stationary magnetic particle layer 27*b* adjacent to the end of the magnetic blade 24 are confined by the balance between the confining or limiting force provided by the gravity, the magnetic force and the confining force provided as the effect of the existence of the magnetic blade 24, and the conveying force provided by the rotation of the surface of the sleeve 22. Therefore, the magnetic particles do not pass through the clearance d formed between the end of the magnetic blade 24 and the sleeve 22. Thus only the thin layer of the non-magnetic developer particles formed on the surface of the sleeve 22 passes through the clearance d during the rotation of the sleeve 22 and conveyed thereon toward the latent image bearing member 3 so as to be opposed thereto. A reference numeral 28*a* depicts the thin coating layer of the non-magnetic developer particles formed on the surface of the sleeve 22. Hereinafter, the portion where the developing sleeve 22 carrying the thin layer of the non-magnetic developer particles is closely opposed to the latent image bearing member 3 is called "a developing portion or position" 32. Adjacent the opposite longitudinal ends of the sleeve 22, there are provided developer blocking members for preventing the application of the non-magnetic developer on the sleeve adjacent the opposite ends.

At the developing portion 32, the non-magnetic developer particles in the non-magnetic developer layer 28*a* on the surface 22 of the sleeve are transferred selectively in accordance with the pattern of the latent image formed on the image bearing member 3, by an electric field provided by a developing bias voltage applied between the latent image bearing member 3 and the developing sleeve 22, the developing bias voltage being produced by a bias electric power source 34 as an alternating voltage superposed with a DC voltage (as to the method of the development, the one disclosed in U.S. Pat. No. 4,395,476 is usable). The bias source 34 may provide an AC voltage or a DC voltage.

The surface of the sleeve 22 from which the developer particles have selectively been transferred to the image bearing member at the developing portion 32 returns to the inside of the container 21 by the continuing rotation of the sleeve 22, and again contacted with the magnetic particle layer. The process of forming the non-magnetic developer particle layer is repeated, and therefore, the developing action on the image bearing member 3 is continuously executed. To the magnetic particle layer, the non-magnetic developer particles 28 is automatically supplied by the above-described circulation of the magnetic particles in the circulating layer 27*c*. In order to prevent the occurrence of the ghost image on the sleeve 22, the sleeve 22 surface may be scraped by a scraper (not shown) to remove the non-consumed developer particles from the sleeve surface when it is returned into the container 21, so that the scraped surface is contacted to the magnetic particle layer for the formation of the next coating of the developer particles.

To the non-magnetic developer particles, silica particle for enhancing the flowability and/or abrasive particles for effectively abrading the surface of the photosensitive member 11 which is the latent image bearing member 3 in an image transfer type image forming apparatus, may be added. Also, the non-magnetic developer powder may contain a small amount of the magnetic particles.

Thus, the developing apparatus described above can stably form for long time a thin coating of uniform thickness of the non-magnetic developer particles which are electrically sufficiently charged, on the developer carrying member surface. Therefore, the latent image on the latent image bearing member can be developed by the thin developer layer with a high sharpness and resolution.

Since non-magnetic developer can provide high chroma color reproduction, a color copy (single color, multi-color or pictorial color) of a high quality in the color reproducibility can be provided. Also, since the magnetic particle confining member is inclined toward downstream with respect to the movement of the developer carrying member, the magnetic field in the tangential direction can be made stronger than that of the radial direction on the developer carrying member and since the circulation of the magnetic particles is improved by the circulation limiting member, the blocking of the developer particles at the magnetic particle confining member and the fusing of the developer or the leakage of the magnetic particles can be prevented. For this reason, a developer for pressure fixing may be used.

Since, when the two layer structure is taken, the magnetic particle layer consisting of the circulating layer and the stationary layer, is formed around the carrying member from the beginning, and since the developer layer does not contain the magnetic particles, or if any, it contains only a small amount to compensate the unavoidably lost magnetic particles, the state of the magnetic particle layer is maintained constant over a long run of the device. In this sense, the magnetic particles within the magnetic particle layer can be deemed as a part of the developing apparatus, rather than a developer agent or a part of a developer agent.

Since the apparatus requires that the components are supplied into the container in a predetermined order, an intended developing operation can not be obtained if they are supplied in an erroneous order. For example, if the non-magnetic developer particles 28 is first supplied to the container 21, and then the magnetic particles 27 are supplied, it is not possible to form a thin layer of uniform thickness of the non-magnetic developer particles on the surface of the sleeve 22 because of the thin layer formation principle, and in addition, the developer particles are leaked and scattered through the clearance between the developing sleeve 22 and the magnetic member 31.

The present invention is effective to strictly prevent such erroneous supply.

Figure 4:
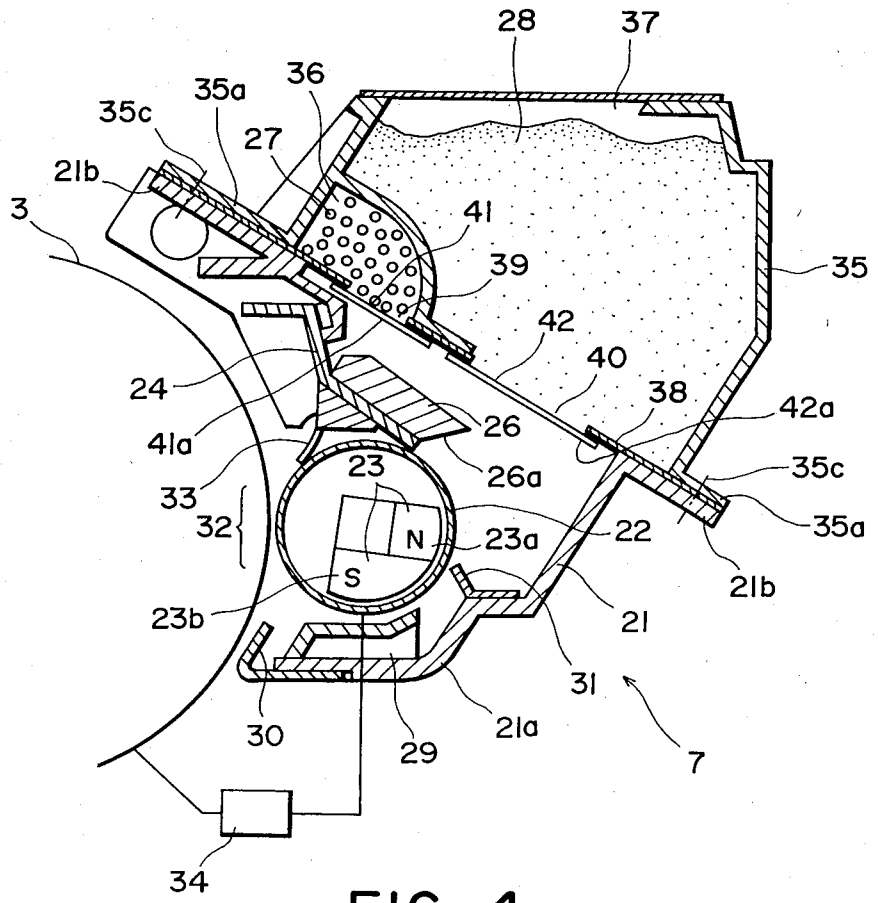
FIG. 4 is a cross-sectional view of a developing apparatus when the magnetic particles and the non-magnetic developer particles are not yet supplied.

FIGS. 4–9 illustrate such an embodiment of the present invention. The same reference numerals are assigned to the elements having the functions similar to those of FIG. 2. In FIG. 4, the apparatus includes a storing container 35 for storing magnetic particles and developer particles. The storing container 35 includes a first storing chamber 36 and a second storing chamber 37 which are partitioned and juxtaposed substantially horizontally. The first storing chamber 36 sealingly stores the magnetic particles 27 (only the magnetic particles, or the mixture of the magnetic particles and non-magnetic developer particles as described hereinbefore). In the second storing chamber 37, the non-magnetic developer particles 28 (only the developer particles, or those added by an agent for enhancing flowability and/or an abrading agent as described before) is sealingly stored.

The storing container 35 is provided at the bottom thereof with a flange 35*a* extending outwardly, which is fixed by screws or the like 35*c* to a flange 21*b* extended outwardly from the edge of the top opening of the container 21. Thus, the storing container 35 is fixedly secured to the developer container 21 to be integral therewith.

The first storing chamber 36 for sealingly storing the magnetic particles 27 is defined at the left hand side of the container 35 as seen in the Figure and is smaller than the second storing chamber 37 for sealingly storing the non-magnetic developer particles 28. However, it has a capacity sufficient to accommodate a necessary amount of the magnetic particles 27. When the storing container 35 is mounted to the top opening of the developer container 21 in the manner described above, the first storing chamber 36 for accommodating the magnetic particles 27 is substantially right above the circulation limiting member 26 of the developer continer 21.

The storing container 35 has a bottom plate 38 which is provided with first and second elongate openings 39 and 40 extending along the length of the respective chambers, corresponding to the first and second storing chamber 36 and 37. Those elongate openings are sealed by first and second sealing members 41 and 42. The first and second sealing members 41 and 42 are larger in width than the first and second openings 39 and 40, respectively, and are larger in length than twice of the respective openings. They are made of long strips (for example, a synthetic resin tape cut out from a sheet) having a high tensile strength and sufficient flexibility.

Figure 5:
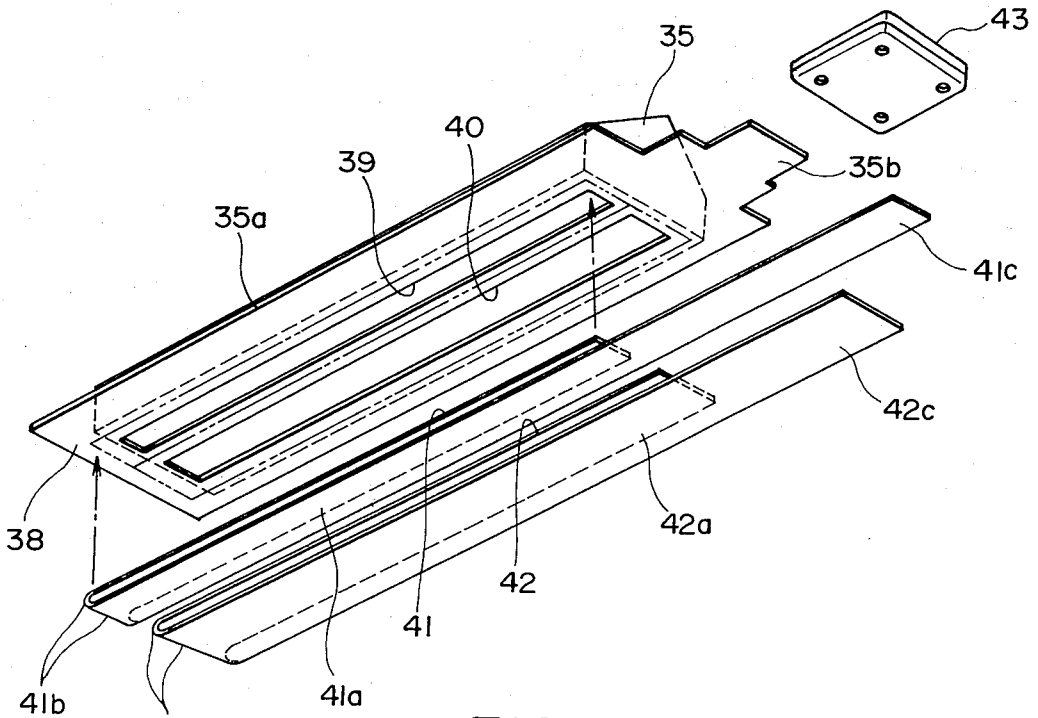
FIG. 5 is an exploded perspective view of a bottom plate of the container and sealing members.
Figure 6:
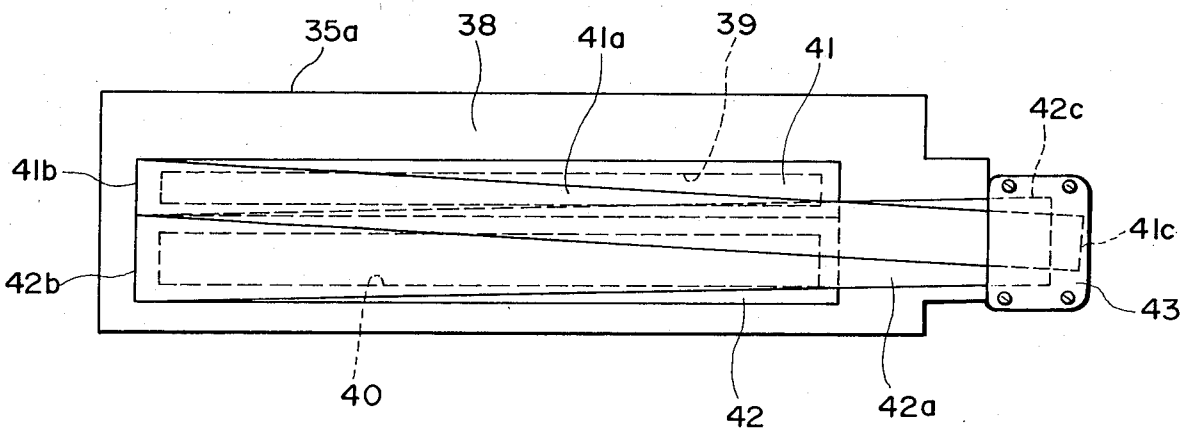
FIG. 6 is a bottom plan view of the bottom plate of the container which has been sealed.

FIGS. 5 and 6 illustrate the application of the sealing members 41 and 42 to the first and second openings 39 and 40. FIG. 5 is an exploded perspective view of the bottom plate 38 seen from the bottom thereof, and FIG. 6 is a bottom plan view of the bottom plate 38 sealed by the sealing members. The first sealing member 41 in the form of a tape covers the first opening 39 from one end to the other end thereof by the length of the sealing member 41 from one end thereof to the point corresponding to the length of the first opening 39, so that the entire opening 39 is covered by the sealing member, and then the length of the sealing member 41, at its edges all around the openings 39 is bonded to the bottom surface of the bottom plate by means of heat-sealing, thus sealing the first opening 39. The rest 41*a* of the sealing member 41 is folded back toward the first end of the sealing member 41, as best seen in FIG. 5, at the portion 41*b*. To the other end, that is, to the free end of the sealing member 41*a*, a gripping member 43 is mounted.

Figure 9:
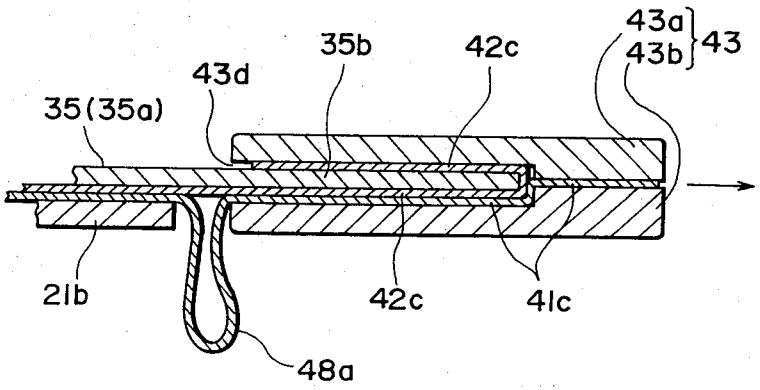
FIG. 9 is a cross-sectional view of the apparatus after the gripping member is mounted.
Figure 7:
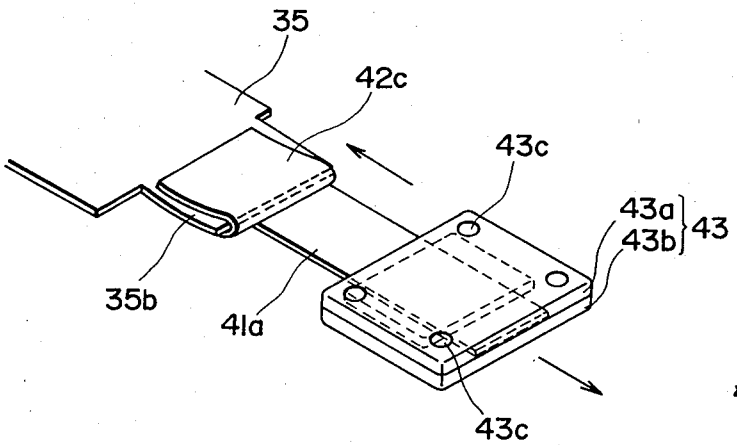
FIG. 7 is a perspective view of the apparatus after the gripping member is retracted.

As shown in FIG. 7, the gripping member 43 includes two plate members 43*a* and 43*b* which are superposed and fixed by screws 43*c*. Between the two plates, the free end 41*c* of the sealing member 41*a* is gripped, before they are screwed, is gripped, thereby fixedly securing the end to the gripping member. An end of the bottom plate of the storing container corresponding to the free end of the sealing member 41*a* is extended outwardly to form an extension 35*b*. The gripping member 43 is provided with a clearance 43*d* between the two plates 43*a* and 43*b* to receive the extension 35*b* (FIG. 9).

Figure 8:
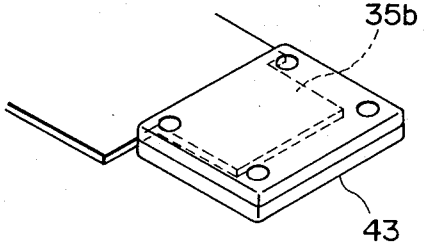
FIG. 8 is a perspective view of the apparatus when the gripping member is mounted.

On the other hand, the second opening 40 is sealed by the second sealing member 42 in the form of a tape, in the manner similar to that of the first opening 39. However, the free end 42*c* of the sealing member 42*a* is folded against the extension 35*b* of the bottom plate from the bottom surface to the top surface thereof, as best shown in FIG. 7. To the extension 35*b* of the bottom plate which is folded in the free end portion 42*c* of the second sealing member 42, the clearance 43*d* of the gripping member 43, to which the free end of the sealing member 41 is fixed, is engaged, so that the gripping memer 43 is mounted to the bottom plate extension 35*b* (FIGS. 8 and 9). By the mounting of the gripping member 43 to the extension 35*b*, the free end 42*c* of the second sealing member 42 is hidden within the clearance 43*d* of the gripping member 43.

The accommodation of the magnetic particles 27 and the non-magnetic developer particles into the first and second storing chamber 36 and 37 of the storing container 35, respectively, and the sealing of the openings 39 and 40 of the bottom plate by the sealing members 41 and 42, are all performed by the manufacturers. The user or operator, when supplying magnetic particles 27 and non-magnetic developer particles 28 into the developer container 21 of the developing apparatus 7 in the predetermined order in order to prepare for the operation, the first and the second sealing members 41 and 42 of the storing container 35 are removed in the following manner.

Figure 10:
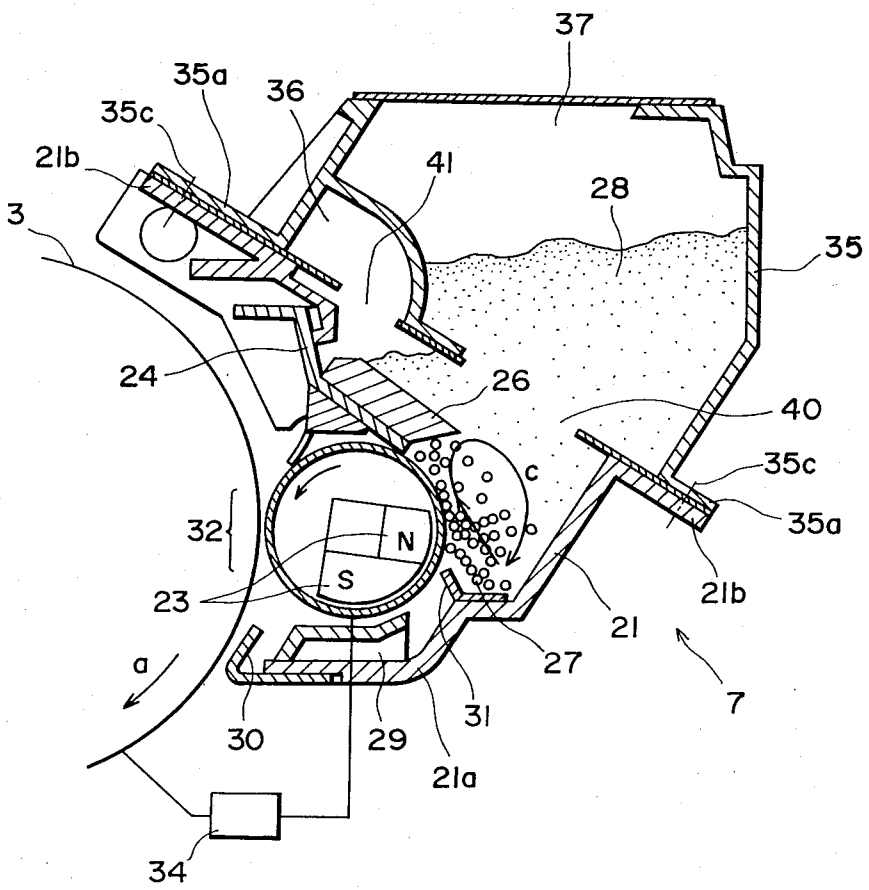
FIG. 10 is a cross-sectional view of the developing apparatus after the magnetic particles and the non-magnetic developer particles are supplied.

First, the operator grips and pulls the gripping member 43 mounted to the extension 35*b* so as to take it out of the extension 35*b*, and continues pulling the gripping member 43 to peel the first sealing member 41 from the folded side of the sealing member 41, thus gradually opening the first opening 39 from that side. This is continued until the first sealing member 41 is completely taking out of the apparatus 7. By this opening of the first opening 39, the magnetic particles 27 within the first storing chamber 36 fall on the top surface of the circulation limiting member 26 which, at this time, functions as a guide for the magnetic particles toward the developer container 21. Then, the magnetic particles flow down on the top surface toward the free end of the limiting member 26. After this, the surface of the sleeve 22 is entirely covered by the magnetic particles at the area within the developer container 21. Next, the free end 42*c* of the second sealing member 42 which has been exposed by the removal of the gripping member 43, is pulled. Then, the second sealing member 42 sealing the second opening 40 is peeled off from the folded portion 42*b*, thus gradually uncovering the opening 40. This is continued until the second sealing member 42 is completely taken out of the apparatus 7. By this operation, the non-magnetic developer particles 28 stored in the second storing chamber 37 is supplied through the second opening 40 into the developer container 21 which already contains the magnetic particles 27, as described above. FIG. 10 illustrates the state after the completion of the supply of the magnetic particles and the non-magnetic developer particles.

It is appreciated that, when the first and the second sealing members 41 and 42 are to be removed, the operator can see only the gripping member 43 for removing the first seal member 41. The free end 42*c* to be accessed by the operator for the removal of the second sealing member 42 can not be seen by the operator, since it is hidden within the gripping member 43. The free end 42*c* is made exposed to be seen by the operator, only after the firt sealing member 41 is removed by pulling the gripping member 43. Thus, operation in an erroneous order can be effectively prevented. That is, it can be avoided to first remove the second sealing member 42 and then remove the first sealing member 41, namely, to first supply the non-magnetic developer particles 28 into the container 21 and then supply the magnetic particles 27 thereinto.

In the embodiment described in the foregoing, two kinds of particles, i.e., the magnetic particles and non-magnetic developer particles are used, but this is not limiting. Also, the foregoing description has been made with respect to a disposable developing apparatus which includes as a unit the developer container 21 and the storing container 35 for storing the magnetic particles 27 and the non-magnetic developer particles 28, but this is not limiting, and the present embodiment is applicable to a developer supply cartridge in which a separate storing container is exchangeably mountable to the developer container 21.

The gripping member 43 may be mounted to another proper projected portion formed on the developing apparatus, rather than to the extension 35*b* from the bottom plate of the storing container. Additionally, it is possible to mount a resilient member at an end of the storing container, such as MOLT PLANE, so as to clean the sealing member at the sealing surface during the removal of the sealing member.

The developing apparatus 7 built in the cartridge A (FIG. 1) contains the storing container 35 mounted to the top of the developer container 21, the storing container 35 sealingly containing the magnetic particles 27 in the first storing chamber 36 and the non-magnetic developer particles 28 in the second storing chamber 37. When the device is shipped from the manufacturer, those chambers are kept sealed. Therefore, magnetic particles 27 and the non-magnetic developer particles 28 are not mixed together with each other or scattered even when it is vibrated or moved during the transportation of the goods. It is not until the users use it that the first and second sealing members 41 and 42 are removed in this order.

As described above, according to this embodiment of the present invention, the two storing portions are provided independently from each other so that the developer particles and the magnetic particles are not mixed and that the developer particles are not scattered even upon the vibration or shock thereto. Furthermore, the first sealing member is provided with a gripping member fixed thereto, and the end of the second sealing member to be handled by the operator is accommodated within the gripping member, so that it can be assured that the sealing members are removed in an erroneous order.

Figure 11:
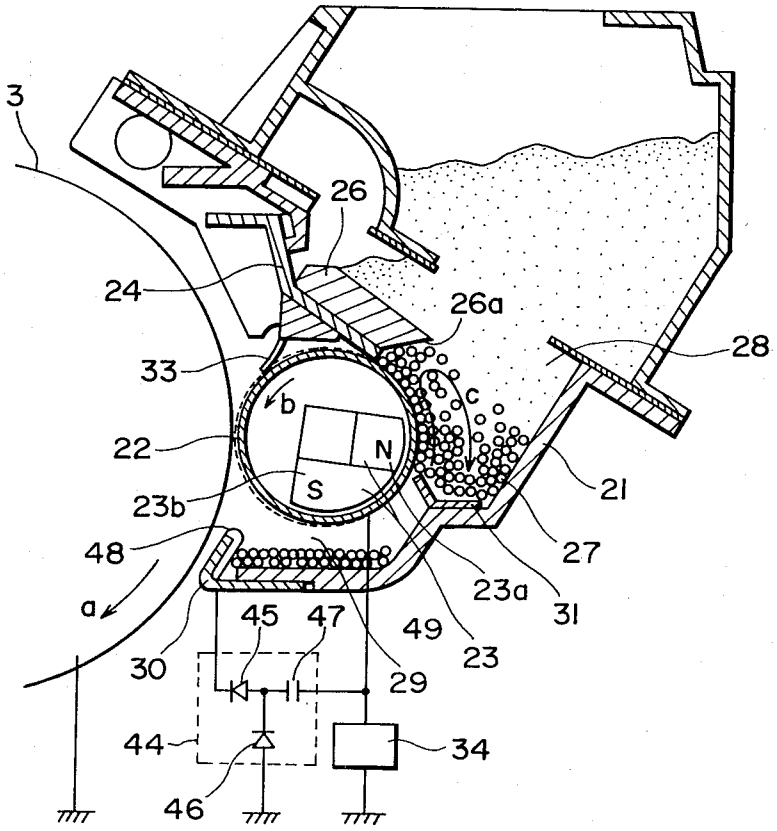
FIG. 11 is a cross-sectional view of the developing apparatus according to an embodiment of the present invention.

The developing operation using the developing apparatus described above will now be described in conjunction with FIG. 11. In this Figure, the developer carrying member 22 is an aluminum sleeve 20 mm diameter having a surface treated by irregular sand-blasting with an ALUNDUM abrasive. The magnetic 23 has two magnetized pole. The N pole and S pole are so positioned as shown in the Figure with the angle $\pi=95$ degrees, which is the angular position of the N pole.

The surface magnetic flux density of this magnet is 500 Gausses at the maximum, but this is preferably increased depending on the developer to be used, particularly when the used developer has a less flowability. It has been observed with human eyes that when the surface flux density is approx. 800 Gausses, the circulation in the direction of the arrow c in FIG. 11 is doubled.

The magnetic blade 24 is a steel plate of 1.2 mm thickness which is chemically nickel-plated. The steel plate is preferably of SPC steel plate, Si steel plate or permalloy. The magnetic blade 24 which is of one of those magnetic material may be so magnetized that the magnetic field is strengthened in the tangential direction. In the apparatus shown in FIG. 11, the angle $\theta=30$ degrees, the angle $\delta$ equal 85 degrees, the clearance between the magnetic blade 24 and the surface of the sleeve 22 is 250 microns. The angle $\delta$ may be 90 degrees, that is, the magnetic blade 24 extends along the tangent of the sleeve surface, but in that case, the magnetic blade 24 can an intentionally contacted to the sleeve surface if the manufacturing precision is not satisfactorily high. This tendency is remarkable when the angle $\delta$ is larger than 90 degrees, so that this range is not preferable from the standpoint of the magnetic particle confinement.

As for the magnetic particles, iron particles (maximum magnetization 190 emu/g) of 100–80 microns (150/200 mesh) are used. For the non-magnetic developer, blue toner is used. The toner particle of average particle size of 10 microns which has been provided by 100 parts of styrene-butadiene copolymer resin and 5 parts of copper phthalocyanine pigment are added by 0.6% of colloidal silica. When the apparatus according to this embodiment was operated under the foregoing conditions, the sleeve 22 was coated with the toner layer of 50–100 microns thickness. The triboelectric charging on the toner in the coated layer was +10 $\mu$c/g, when measured by a blow-off method. Depending on the magnetic properties of the magnetic particles, the stationary layer 27*b* as shown in FIG. 2 does not extend to the position of the magnetic blade 24, resulting in a space not having the magnetic particles between the stationary layer 27*b* and the magnetic blade 24. This can allow the toner particles to leak through the clearance between the magnetic blade 24 and the surface of the sleeve. In view of this, the magnetic particles are such that they form a sufficiently long magnetic brush.

The developing apparatus according to this embodiment was then actually incorporated into a PC-10 copying machine (available from Canon Kabushiki Kaisha, Japan) and operated with the bias voltage 34 of 1600 Hz, and the peak-to-peak voltage of 1300 V of AC superposed with DC of −300 V. The sleeve 22 was set to the photosensitive member 3 of organic photoconductor with the clearance therebetween of 250 microns, then a good blue color image was obtained.

Next, description will be made with respect to a member 30 for preventing the developer particles from scattering around. The member 30, as shown in FIG. 11, is disposed to the photosensitive member 3 with a clearance of 0.5–2.0 mm at the bottom of the developer container 21 and at a location downstream of the sleeve 22 with respect to the movement of the photosensitive member 3. Without the preventing member 30, the non-magnetic developer scattered at the developing portion 32 moves along the photosensitive member rotation, and contaminates the part of the copying machine located below the developing apparatus.

To avoid the scattering, a voltage of the same polarity as that of the charging polarity of the non-magnetic developer is applied to the member 30, whereby the floating developer particles produced mainly during the developing process are attracted to the photosensitive member, thus preventing the developer particles from leaking out of the developer container 21. The developing apparatus is provided with a developing bias source 34 to supply an AC bias voltage to the sleeve 22. The apparatus further includes a rectifying circuit 44 for rectifying the alternating voltage from the bias source 34 and supplying the rectified voltage to the preventing member 30, so that the voltage of the polarity, the same as the charging polarity of the non-magnetic developer particles, is applied to the preventing member 30. The preventing member 30 may be made of a magnetic material, but a non-magnetic material is preferable because it does not disturb the magnetic field of the developing apparatus. In an example of this embodiment, a copper plate having the thickness of 0.6 mm, the width of 6 mm and the length of 210 mm was opposed to the photosensitive member 3 with a clearance of 0.8 mm. As for the alternating developing bias source 34, a voltage source of 1.6 kHz, 1.3 kV peak-to-peak voltage of AC superposed with DC of 300 V was used. The rectifying circuit is of the type of a voltage doubler including diodes 45 and 46 and capacitor 47. Using this, half-wave voltage of VH=1200 V and VL=900 V is produced, which is applied to the prevention member 30. The amount of the scattered developer was reduced down to ½–1/20, as compared with the case without the member 30.

In this embodiment, the output of the rectification circuit is applied, as it is, to the preventing member of a conductive material, but a smoothing circuit may be used to supply a complete DC voltage to the member 30. In addition, the circuit may be of triple voltage type or a multiplied voltage type, provided that the photosensitive drum 3 is not damaged. Furthermore, the circuit may consist of the diode 45 or of the diode 45 and the capacitor 47.

Designated by reference numeral 48 is a sheet of an insulating material, which is effective to prevent the occurrence of an insufficient insulation between the member 30 and the sleeve 22 by the magnetic particles, when a small amount of the magnetic particles are leaked out of the developer container 21. In place of the insulating sheet 48, an insulating paint may be applied.

In this embodiment, a developer collector 29 in the form of a trough for receiving the leaked developer particles, opening upwardly and extending along the length of the apparatus below the sleeve 22. The developer collector 29 is provided with a member 49 of a foam material. The foam material 49 may be a sponge, EVERLIGHTSCOT or felt which is an open-cell foam, having, for example 15–40 cells, preferably, 20–35 cells per 25 mm$^2$.

The developer particles slightly leaked from the portion adjacent the magnetic member 31, or a part of the developer not consumed for the development, fall on the foam member 49 in the collector 29. Those developer particles are soaked into the cells of the foam member 49 by the gravity or the apparatus vibration, and therefore, they are captured by the foam member. Accordingly, even if the developer is leaked through the clearance between the magnetic member 31 and the sleeve 22 because of, for example, carrying or moving the copying apparatus, or vibrating and moving the cartridge A during the interchanging of the cartridges, and because of the positioning of the cartridge A taken out of the apparatus, the leaked developer is effectively prevented from scattering.

In those embodiment, the non-magnetic developer is used, but magnetic developer may also be usable, if the magnetism thereof is very weak as compared with that of the magnetic particle and if the developer is triboelectrically chargeable. Also, the developing apparatus is of a disposable type wherein the developer container is integral with the developer storing container, but those embodiments are applicable to an apparatus wherein the storing container is a replaceable supply cartridge which is separate from the developer container. As for the method of development, a non-contact type development as disclosed in U.S. Pat. No. 4,395,476 has been described, but this is not limiting. For example, a contact type development using a resilient rubber as the developer carrying member is usable.

Figure 12:
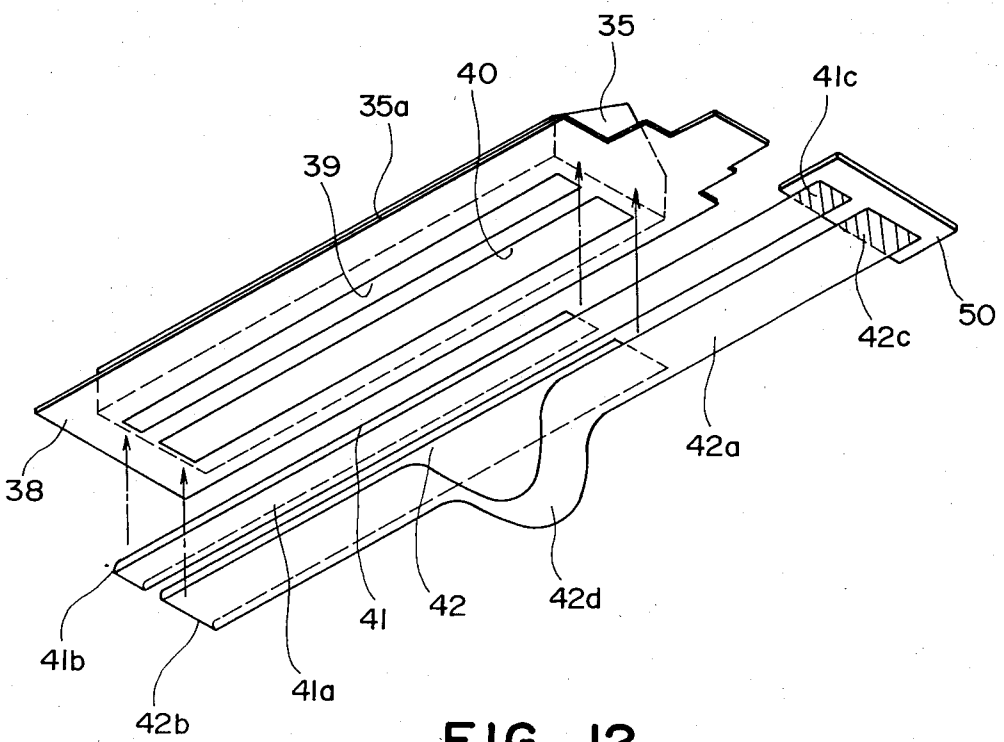
FIGS. 12–14 are exploded perspective views of the container bottom plate and the sealing members of the apparatus according to other embodiments of the present invention.
Figure 13:
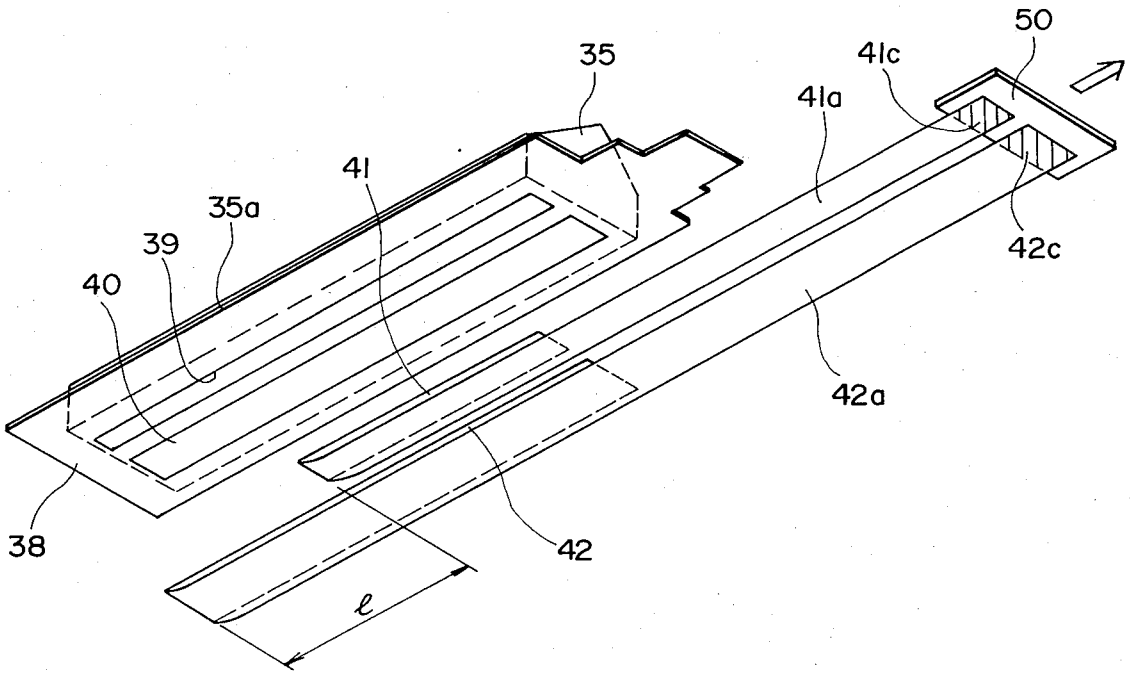

Another embodiment of the present invention will be described. FIGS. 12 and 13 illustrate the manner of application of the sealing members 41 and 42 to the first and second openings 39 and 40, respectively. FIG. 12 is an exploded perspective view of the bottom plate 38 seen from the bottom, while FIG. 13 is an exploded perspective view indicating the state wherein the sealing member is being removed. The first opening 39 is covered through its entire length by the length of the first sealing member 41 in the form of a tape from its one end, corresponding to the length of the first opening 39. Then, the peripheral edges of the first sealing member 41 is bonded to the bottom plate surface around the opening 39 by means of, for example, heat sealing, thus sealing it. The rest 41*a* of the first sealing member 41 is folded back toward said one end of the first sealing member 41. Designated by reference numeral 41*b* is the folded portion.

On the other hand, the second opening 47 is sealed by a second sealing member 42 in the form of a tape in the manner similar to the case of the first opening 39. The free ends 41*c* and 42*c* of the first and second sealing members 41*a* and 42*a* are bonded to a gripping member 50 at the hatched portion. The free ends may be fixed in the manner as described with respect to the gripping member 43. The rest of the second sealing member 42, that is the trailing portion of the second sealing member 42 folded back at the portion 42*b* is made longer than the corresponding portion of the first sealing member 41*a* by the length l. To achieve this, the second sealing member 42 has a slack 42*d* before it is bonded to the gripping member 50.

After the storing container 35 is treated for sealing, it is combined with the developing apparatus. The removal of the sealing members is effected by the operator pulling the grip 50. The states of the first and second sealing members during the removing action are shown in FIG. 13. By pulling the grip 50, that is, pulling the first sealing member 41, the first opening is gradually opened from the folded portion 41*b*. Because of the difference l between the first sealing member 41 and the second sealing member 42, provided by the slack, the second opening starts to be unsealed from the folded portion 42*b*, when the grip 50 is pulled through the distance l. With the deviation l of the unsealing positions being kept, the first and second sealing members are pulled out. Therefore, the magnetic particles 27 fall on the sleeve 22 necessarily earlier than the non-magnetic developer particles 28 fall. In this manner, as shown in FIG. 10, the magnetic particles 27 are first supplied onto the sleeve 22, and then the non-magnetic developer particles 28 are supplied on the layer of the magnetic particles, so that the possibility of the non-magnetic developer particles being scattered out can be prevented. The length difference l between the first sealing member 41 and the second sealing member 42 is properly determined on the basis of the extension of the magnetic particles and the extension of the non-magnetic developer particles thereon when they fall on the sleeve 22. When the non-magnetic developer particles having a high flowability fall thereon, they expand or extend in the longitudinal direction. In consideration thereof, the length l is to be determined such that the developer particles do not extend to the surface of the sleeve 22 not yet covered by the magnetic particles. According to this embodiment, the possibility of supplying the non-magnetic developer particles first can be avoided with certainty by the simple structure wherein the length from the folded portion of the first sealing member to the grip is made different from the corresponding length of the second sealing member. Additionally, this embodiment is advantageous in that the single pulling action is effective to remove the first and second sealing members 41 and 42 in the correct order.

Figure 14:
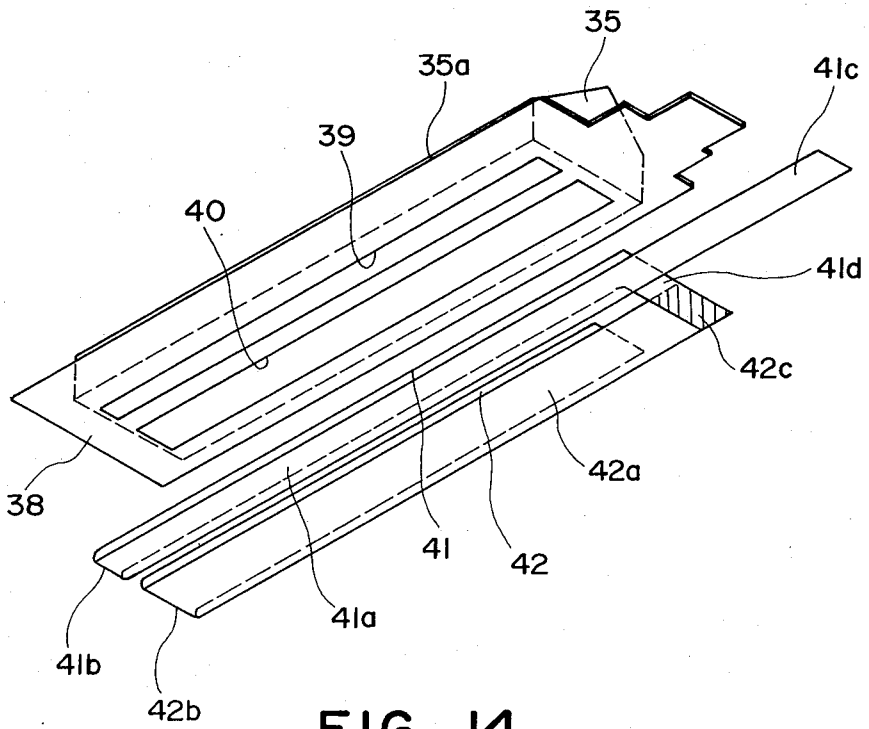

FIG. 14 shows a further embodiment of the present invention, and is an exploded perspective view of a bottom plate 38 seen from the bottom, illustrating the manner of application of the sealing members 41 and 42 to the first and second openings 39 and 40, respectively. The first opening 39 is covered through its entire length by the length of the first sealing member 41 in the form of a tape from its one end corresponding to the length of the first opening 39, and the peripheral edges of the first sealing member is bonded to the bottom plate around the first opening 39 by means of, for example, heat sealing, thus sealing the opening. The rest 41*a* of the length of the sealing member 41 is folded back toward said one end thereof at the portion indicated by the reference numeral 41*b*.

On the other hand, the second opening 40 is sealed by the second sealing member 42 in the form of a tape in the manner similar to the case of the first opening 39. Said one end 41*d* of the first sealing member 41 is bonded to the free end 42*c* of the second sealing member 42 at the portion indicated by the hatching. With the sealing members being thus bonded, the storing container 35 is build in the developing apparatus. After it is build in, only the free end 41*c* of the first sealing member is projected out of the apparatus. When the operator pulls this end 41*c* of the first sealing member, the first sealing member 41 is first removed so as to allow the magnetic particles 27 to fall into the developer container 21. The first sealing member 41 is gradually peeled off from the folded portion 41*b* until the trailing edge 41*d* is peeled off. The end 41*c* of the first sealing member 41 is further pulled, then the end 42*c* of the second sealing member which is hidden in the developing apparatus is pulled. Then, the end 42*c* of the second sealing member is taken out of the device by the end 41*d* of the first sealing member. This allows the operator to grip and pull the end 42*c* of the second sealing member, thus introducing the non-magnetic developer particles into the developer container. The first and second sealing members 41 and 42 may be made integral as a single seal. According to this embodiment, as shown in FIG. 10, the magnetic particles are first supplied onto the sleeve 22, only then the non-magnetic developer particles are supplied onto the layer of the magnetic particles, so that the possibility of the non-magnetic developer particles scattering out can be avoided.

Figure 15:
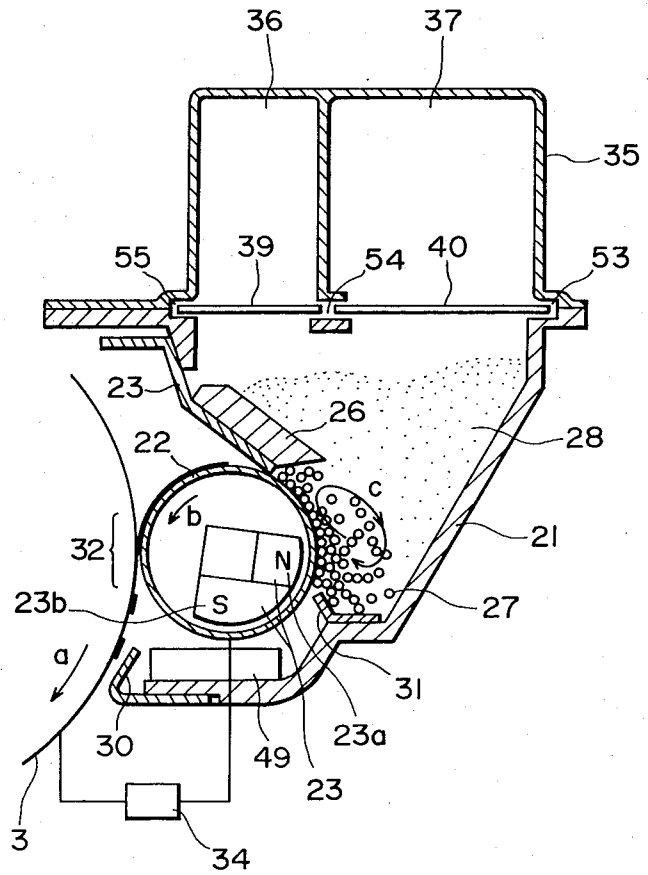
FIG. 15 is a cross-sectional view of a developing apparatus according to another embodiment of the present invention.
Figure 16:
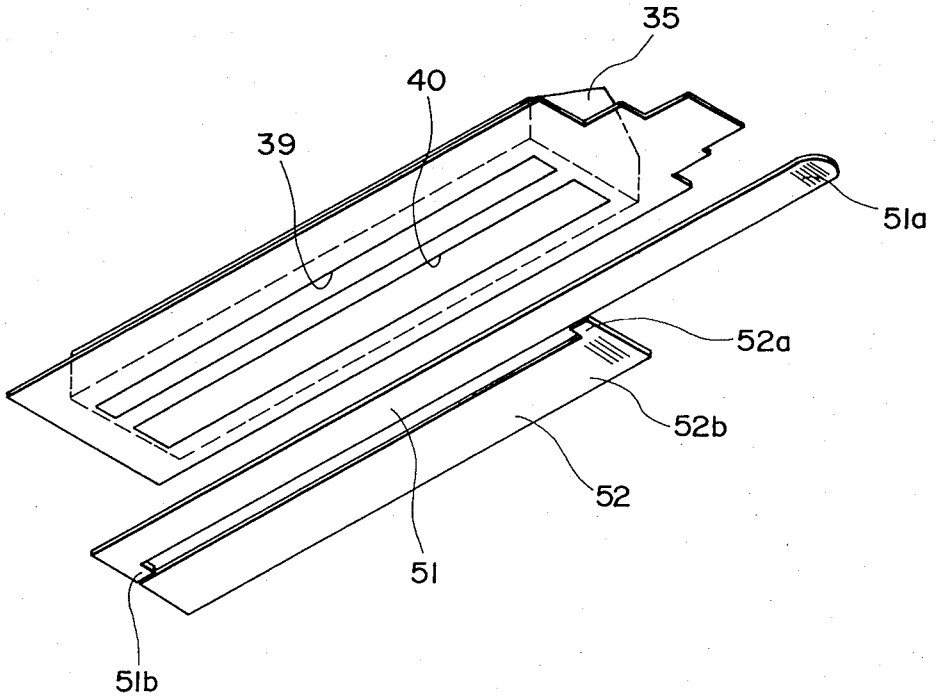
FIG. 16 is an exploded perspective view of the developer container and sealing members.

FIG. 15 is a cross-sectional view of a developing apparatus according to another embodiment of the present invention. FIG. 16 is an exploded perspective view illustrating the manner applying the sealing members. The first opening 39 is sealed by the first sealing member 51 which is made of a thin resin sheet or metal sheet and is inserted into the grooves 53 and 54 formed between the container 35 and the developer container 21 in the manner that the grip 51*a* is extended out of the developing apparatus. Designated by reference numeral 52 is a second sealing member for sealing the second opening 40. It is of the material similar to that of the first sealing member 51 and inserted into the grooves 54 and 55 in the manner that almost all of it is hidden in the developing apparatus. When the developing apparatus is to be used, the operator first pulls the grip 51*a* to remove the first sealing member 51 to allow the magnetic particles 27 to fall into the developer container 21. At a certain point during the first sealing member 51 being pulled, a projection 51*b* formed at the rear end thereof engages with a projection 52*a* formed on the second sealing member 52, thus pulling the end 52*b* of the second sealing member 52 out of the developing appartus. Then, the operator grips the end 52*b* of the second sealing member 42 and removes the second sealing member 52 so as to allow the non-magnetic developer particles 28 to fall into the container 21 from the storing chamber 37. Thus, similarly to the foregoing embodiments, the magnetic particles and non-magnetic developer particles can be supplied into the container 21 in a correct order with certainty.

As described in the foregoing, according to the embodiments shown in FIGS. 14–16, it is ensured by a simple structure that the operator can supply two kinds of particles in an correct order. Additionally, since the removal of the second sealing member 52 is made possible only after the first sealing member 51 is completely pulled out, the non-magnetic developer particles can be introduced into the developer container after the sleeve 22 is positively covered by the magnetic particles. Therefore, the problem of the toner scattering can be avoided.

Figure 17:
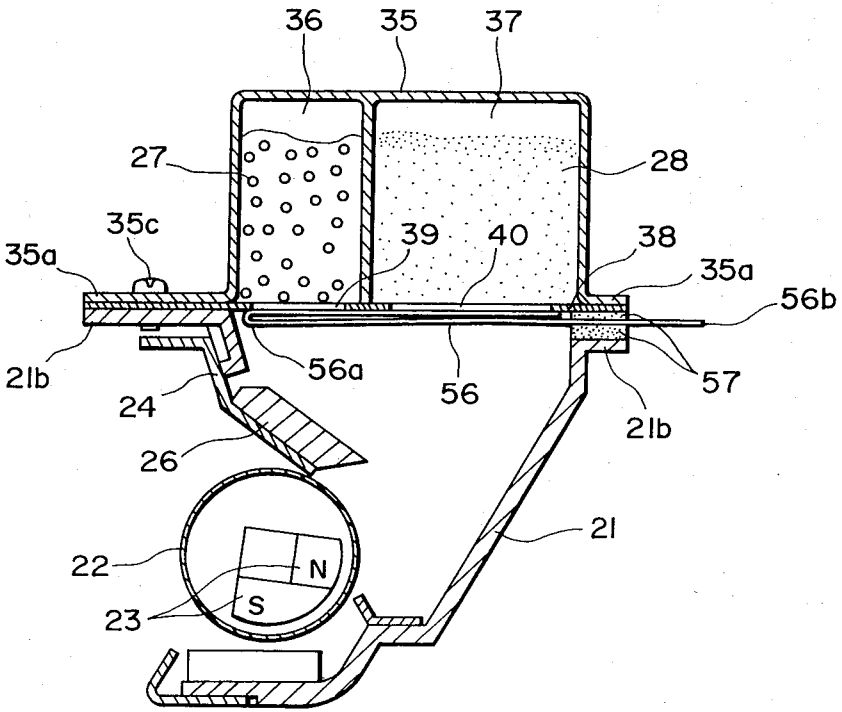
FIG. 17 is a cross-sectional view of a developing apparatus according to another embodiment of the present invention, which shows the state before the magnetic particles and non-magnetic developer particles are supplied.
Figure 18:
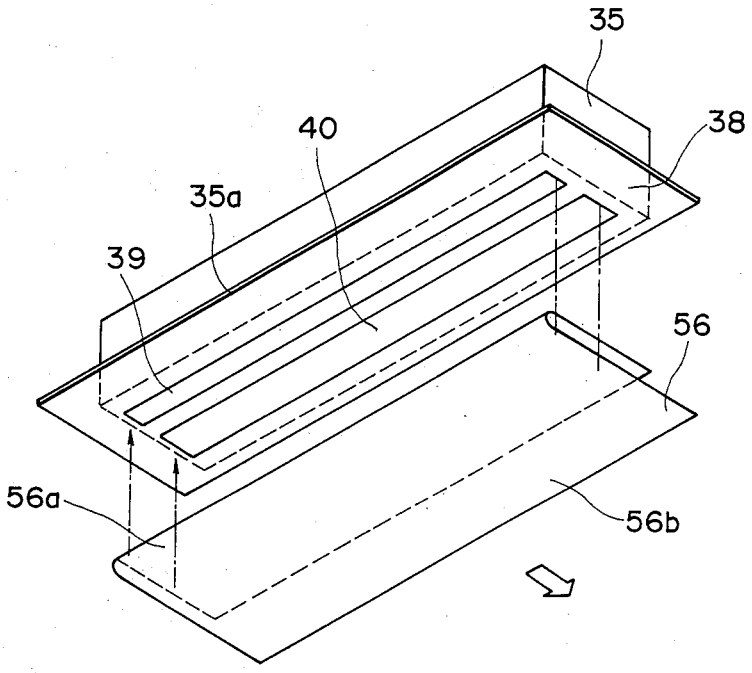
FIG. 18 is an exploded perspective view of the container bottom plate and a sealing member.
Figure 19:
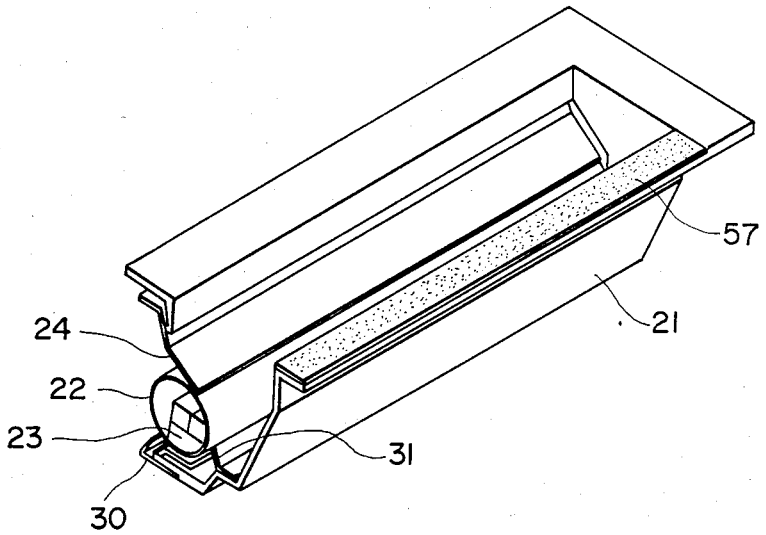
FIG. 19 is a perspective view of the developer container.

FIGS. 17–19 illustrate a developing apparatus according to another embodiment of the present invention. Since this embodiment is similar to the foregoing embodiment, except for the portions which will be described, the details description of the similar portion is omitted for the sake of simplicity by assigning the same reference numerals to the elements having the corresponding functions. In this embodiment, as shown in FIG. 17, the bottom plate 38 of the storing container 35 is provided with first and second elongate openings 39 and 40 extended along the length of the first storing chamber 36 and the second storing chamber 37. Those openings are sealed by a sealing member 56. The width of the sealing member 56 is larger than the longitudinal length of the first and second openings 39 and 40, and the length thereof is larger than twice of the combined width of the first and second openings 39 and 40. It is made of a flexible tape having a high tensile strength (for example, a synthetic resin sheet cut into tapes).

FIG. 18 is an exploded perspective view of a bottom plate 38 seen from the bottom, illustrating the manner of the application of the sealing member 56 to the first and second openings 39 and 40. FIG. 19 is a perspective view of the developer container.

The sealing member 56 covers the first opening 39 and the second opening 40 through their entire length on the bottom plate 38. The sealing member 56 is then bonded to the bottom plate 38 around the openings by means of for example, heat sealing, thus sealing the openings. The rest of the sealing member 56 is folded back at the portion 56*a* to extend through a side of the storing container 35 to provide an exposed end 56*b* of the sealing member 56. With this state, the storing container 35 and the developer container 21 are combined to be a unit. In order for the operator to supply the magnetic particles 27 into the container 21 and the non-magnetic developer particles 28 thereinto in this order to place the developing apparatus into an operable condition, it is enough to simply pull the end 56*b* of the sealing member 56. When the operator pulls the end 56*b*, the sealing member 56 is gradually peeled off from the folded portion 56*a*, so that the first opening 39 is first unsealed, with the result that the magnetic particles 27 are allowed to fall through the opening 39 onto the circulation limiting member 26 in the developer container 21. The magnetic particles slide on the inclined upper surface of the limiting member 26 to the free end thereof, where they fall into the container 21. Thus, the surface of the developing sleeve 22 is entirely covered by the magnetic particles at the area inside the developer container 21.

The continued pulling action of the sealing member 56 opens the second opening 40. The sealing member 56 is continued to be pulled until it is completely taken out of the developing apparatus. By this, the non-magnetic developer particles 28 stored in the second storing chamber 37 is introduced into the developer container to which the magnetic particles 27 have already been supplied through the second opening 40. Designated by reference numeral 57 is a packing member which is effective to clean the sealing member 56 by removing therefrom the magnetic particles and non-magnetic developer particles deposited thereon and which is also effective to prevent the leakage of the particles through the slit. It is preferable that the magnetic particles and the non-magnetic developer particles fall uniformly along the entire length of the developer carrying member or sleeve 22, and therefore, the openings 39 and 40 are preferably parallel with the length of the carrying member 22 and extends as long as the sleeve 22.

According to this embodiment of the present invention, the operator can supply, with certainty by a simple and single action, that is, pulling the seal, the developer particles and the non-magnetic developer particles in this order. Additionally, since the seal is peeled off in the direction perpendicular to the length of the developer carrying member, the distance through which the seal is pulled is short to facilitate the operation.

In the foregoing embodiments, two kinds of particles, i.e., the magnetic particles and the non-magnetic developer particles are used, but the present invention is not limited to the kinds of the developer. Also the foregoing description has been made with a disposable type developing apparatus containing the storing container 40 for storing the magnetic particles and the non-magnetic developer particles and the developer container 21 as a unit, but the present invention is applicable also to the developer supply cartridge which is separate from the developing apparatus and can be exchanged.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing a latent image formed on a latent image bearing member, comprising:

a developer carrying member, provided at an opening of a developer container, for carrying thereon a developer to a developing position;

a developer storing container, provided at an upper portion of the developer container, and having a first developer storing portion and a second developer storing portion, said first and second storing portions being provided with first and second openings, respectively, said developer storing container having a bottom plate and said first and second openings being formed in said bottom plate in such a manner that they are juxtaposed; and first and second sealing members for sealing said first and said second openings of said first storing portion and the second storing portion, respectively, wherein said first and second sealing members are capable of being pulled substantially in the same direction so as to open first said first opening and then said second opening.

2. An apparatus according to claim 1, wherein said said developer carrying member includes a rotatable member of non-magnetic material enclosing a magnet, and wherein said first storing portion mainly contains magnetic particles, and said second storing portion mainly contains non-magnetic developer particles, such that a surface of said developer carrying member is first supplied with the magnetic particles from said first storing portion, and then is supplied with the non-magnetic developer.

3. An apparatus according to claim 2, wherein said non-magnetic rotatable member is a rotatable sleeve, and said magnet is a stationary magnet, and further comprising a magnetic doctor blade closely opposed to said sleeve at a position downstream of a magnetic pole of said magnet with respect to the direction of rotation of said sleeve.

4. An apparatus according to claim 3, wherein said first storing portion is substantially above said magnetic doctor blade.

5. An apparatus according to claim 1, wherein said first and second sealing members constitute a single sealing member, and wherein said first and second openings are unsealed by pulling the single sealing member in the direction perpendicular to the length of the first and seocnd openings.

6. A developing apparatus for developing a latent image formed on a latent image bearing member, comprising:

a developer carrying member, provided at an opening of a developer container, for carrying thereon a developer to a developing position;

a developer storing container, provided at an upper portion of the developer container, and having a first developer storing portion and a second developer storing portion, said first and second storing portions being provided with first and second openings, respectively; and a gripping member to which an end of said first sealing member is fixed, and which is capable of accommodating therein an end of said second sealing member.

7. A developing apparatus for developing a latent image formed on a latent image bearing member, comprising:

a developer carrying member, provided at an opening of a developer container, for carrying thereon a developer to a developing position;

a developer storing container, provided at an upper portion of the developer container, and having a first developer storing portion and a second developer storing portion, said first and second storing portions being provided with first and second openings, respectively; and first and second sealing members for sealing said first and second openings of said first storing portion and the second storing portion, respectively, and wherein said second sealing member is longer than said first sealing member, and further comprising a gripping member, the free ends of said sealing members being fixedly mounted to said gripping member.

8. A developing apparatus for developing a latent image formed on a latent bearing member, comprising:

a developer carrying member, provided at an opening of a developer container, for carrying thereon a developer to a developing position;

a developer storing container, provided at an upper portion of the developer container, and having a first developer storing portion and a second developer storing portion, said first and second storing portions are provided with first and second openings, respectively; and first and second sealing members for sealing said first and second openings of said first storing portion and said second storing portion, respectively, and wherein said first sealing member has a fixed end coupled to a free end of said second sealing member.

9. An apparatus according to claim 8, wherein said first and second sealing members are formed by a single continuous sheet-like member.

10. A developing apparatus for developing a latent image formed on a latent bearing member, comprising:

a developer carrying member, provided at an opening of a developer container, for carrying thereon a developer to a developing position;

a developer storing container, provided at an upper portion of the developer container, and having a first developer storing portion and a second developer storing portion, said first and second storing portions being provided with first and second openings, respectively; and first and second sealing members for sealing said first and second openings of said first storing portion and said second storing portion, respectively, and wherein said first and second sealing members are each in the form of a plate-like member, and wherein they are provided with projections engageable with each other to allow unsealing operation of said second sealing member only after unsealing operation of said first sealing member.

11. An apparatus according to any one of claims 1, 6–9 or 5, each of said first and second sealing members is longer than twice the length of said first and/or second opening enough to be folded and seal.

12. A developing apparatus for developing a latent image formed on a latent bearing member, comprising:

a developer carrying member, provided at an opening of developer container, for carrying thereon a developer to a developing position;

a developer storing container, provided at an upper portion of the developer container, and having a first developer storing portion and a second developer storing portion, said first and second storing portions being provided with first and second openings, respectively;

first and second sealing members for sealing said first and second openings of said first storing portion and the second storing portion, respectively; and a cleaning member for cleaning said sealing members by removing therefrom the developer deposited thereon.

13. A storing container for storing a developer, comprising:

a first developer storing chamber for storing a first component of the developer;

a second developer storing chamber for storing a second component of the developer;

said first and second storing chambers being provided with first and second openings, respectively; and first and second sealing members for sealing said first and second openings, wherein said storing container has a bottom plate, said first and second openings are formed in said bottom plate in such a manner that they are juxtaposed, and said first and second sealing members are capable of being pulled substantially in the same direction to open first said first opening and then said second opening.

14. A developing apparatus for developing a latent image formed on a latent image carrying member, comprising:

a developer container;

a developer storing container having a first and second storing portions which are independent from each other for storing non-magnetic developer particles and magnetic developer particles, said first and second storing portions being provided with respective openings;

first and second sealing members for sealing said openings, respectively;

a gripping member to which an end of said first sealing member is fixedly mounted and which is capable of accommodating therein an end of said second sealing members;

a developer carrying member, provided at an opening of said developer container, and endlessly movable inside and outside said developer container;

magnetic field generating means provided in said developer carrying member;

a magnetic particle confining member disposed to an outer surface of said developer carrying member with a clearance therefrom, said confining member being inclined toward downstream with respect to movement of said developer carrying member;

a circulation limiting member, fixedly mounted to said developer particle confining member, for limiting circulation of the magnetic particles;

a magnetic member disposed adjacent to an inlet of said developer container for the developer particles to cooperate with said magnetic field generating means to form a magnetic brush of magnetic particles between said developer carrying member and said developer container, said magnetic member being inclined toward upstream of said magnetic field generating means with respect to the movement of said developer carrying member;

a developer collector, disposed upstream of said magnetic member with respect to movement of said developer carrying member, for collecting the developer particles; and a member for preventing the developer particles from scattering, said preventing member being opposed to the latent image bearing member at the opening of said developer container, wherein a voltage of a polarity which is the same as the charge polarity of the non-magnetic developer particles is applied to said preventing member.

15. A developing apparatus for developing a latent image formed on a latent image bearing member, comprising:

a developer carrying member, provided at an opening of a developer container, for carrying thereon a developer to a developing positon;

a developer storing container, provided at an upper portion of the developer container, and having a first developer storing portion and a second developer storing portion, said first and second storing portions being provided with first and second openings, respectively;

first and second sealing members for sealing said first and second openings of said first storing portion and said second storing portion, respectively; and a porous member for collecting developer particles, disposed substantially vertically below the opening of the developer container and mounted to the developer container.

16. An apparatus according to claim 15, further comprising a magnetic member, and wherein said developer carrying member is a sleeve of non-magnetic material enclosing a stationary magnetic pole, said magnetic member being located across said sleeve from said stationery magnetic pole, and wherein said porous member is disposed upstream, with respect to peripheral movement of said sleeve, of a magnetic field formed between said stationary magnetic pole and said magnetic member.

17. An apparatus according to claim 16 wherein said sleeve encloses a stationary magnetic pole which is effective to provide magnetic force for carrying the magnetic particles on said sleeve, wherein said first storing portion mainly contains magnetic particles, and said second storing portion mainly contains non-magnetic developer particles, whereby a surface of said developer carrying member is first supplied with magnetic particles from said first storing portion and then is supplied with the non-magnetic developer particles from said second storing portion onto the already supplied magnetic particles.

18. An apparatus according to claim 15, wherein said porous member is a sponge having continuous pores.

19. An apparatus according to any one of claims 6–8, 10, 12, 13 and 15, wherein said developer carrying member is a rotatable member of non-magnetic material enclosing a magnet, and wherein said first storing portion mainly contains magnetic particles, and said storing portion mainly contains non-magnetic developer particles, wherein a surface of said developer carrying member is first supplied with the magnetic particles from said first storing portion, and then supplied with the non-magnetic developer particles from said second storing portion onto the aleready supplied magnetic particles.

* * * * *

UNITED STATES PATENT AND TRADEMARK OFFICE

CERTIFICATE OF CORRECTION

PATENT NO. : 4,615,608

DATED : OCTOBER 7, 1986

INVENTOR(S) : MORIKAZU MIZUTANI

It is certified that error appears in the above-identified patent and that said Letters Patent is hereby corrected as shown below:

COLUMN 4

Line 8, "has" should read --as--.
Line 20, "A" should read --After a--.

COLUMN 5

Line 18, "22 in" should read --22. In--.

COLUMN 8

Line 64, "for long" should read --for a long--.

COLUMN 10

Line 48, "screwed, is gripped, thereby" should read --screwed, thereby--.
Line 66, "memer 43" should read --member 43--.

COLUMN 11

Line 23, "taking" should read --taken--.
Line 50, "seal" should read --sealing--.
Line 55, "firt" should read --first--.

COLUMN 12

Line 39, "are removed" should read --are not removed--.
Line 46, "magnetic 23" should read --magnet 23--.
Line 47, "pole." should read --poles.--.
Line 64, "equal" should read --equals--.

UNITED STATES PATENT AND TRADEMARK OFFICE

CERTIFICATE OF CORRECTION

PATENT NO. : 4,615,608

DATED : OCTOBER 7, 1986

INVENTOR(S) : MORIKAZU MIZUTANI

It is certified that error appears in the above-identified patent and that said Letters Patent is hereby corrected as shown below:

COLUMN 13

Line 1, "an" should read --be--

COLUMN 14

Line 6, "of 300 V" should read --of -300 V--.
Line 54, "embodiment," should read --embodiments,--.

COLUMN 16

Line 29, "build" should read --built--.
Line 30, "build" should read --built--.

COLUMN 17

Line 19, "an" should read --a--.
Line 31, "details" should read --detailed--.

COLUMN 18

Line 15, "is" should read --are--.

COLUMN 19

Line 10, Delete "said."
Line 35, "seocnd" should read --second--.

UNITED STATES PATENT AND TRADEMARK OFFICE

CERTIFICATE OF CORRECTION

PATENT NO. : 4,615,608

DATED : OCTOBER 7, 1986

INVENTOR(S) : MORIKAZU MIZUTANI

It is certified that error appears in the above-identified patent and that said Letters Patent is hereby corrected as shown below:

COLUMN 20

Line 5, "latent bearing" should read --latent image bearing--.
Line 13, "are" should read --being--.
Line 25, "latent bearing" should read --latent image bearing--.
Line 47, "seal." should read --sealed.--.
Line 49, "latent bearing" should read --latent image bearing--.
Line 51, "of developer" should read --of a developer--.

COLUMN 21

Line 28, "members;" should read --member;--.

UNITED STATES PATENT AND TRADEMARK OFFICE

CERTIFICATE OF CORRECTION

PATENT NO. : 4,615,608

DATED : OCTOBER 7, 1986

INVENTOR(S) : MORIKAZU MIZUTANI

It is certified that error appears in the above-identified patent and that said Letters Patent is hereby corrected as shown below:

COLUMN 22

Line 8, "positon" should read --position--.
Lines 26 to 27, "sta-tionery" should read --stationary--
Line 51, "said storing" should read --said second storing--.
Line 57, "aleready" should read --already--.

Signed and Sealed this

Twenty-first Day of April, 1987

*Attest:*

DONALD J. QUIGG

*Attesting Officer*

*Commissioner of Patents and Trademarks*